US009591397B2

(12) United States Patent
Sprinkle

(10) Patent No.: US 9,591,397 B2
(45) Date of Patent: Mar. 7, 2017

(54) LOUDSPEAKER MOUNTING ASSEMBLY

(71) Applicant: Harman International Industries, Incorporated, Northridge, CA (US)

(72) Inventor: Charles M. Sprinkle, Ventura, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 4 days.

(21) Appl. No.: 14/482,333

(22) Filed: Sep. 10, 2014

(65) Prior Publication Data

US 2015/0049898 A1 Feb. 19, 2015

Related U.S. Application Data

(60) Continuation of application No. 13/550,338, filed on Jul. 16, 2012, now abandoned, which is a division of application No. 11/697,226, filed on Apr. 5, 2007, now Pat. No. 8,224,014.

(51) Int. Cl.

| | |
|---|---|
| ***H04R 1/02*** | (2006.01) |
| ***H04R 1/28*** | (2006.01) |
| ***H04R 1/34*** | (2006.01) |

(52) U.S. Cl.

CPC ..... *H04R 1/28* (2013.01); *H04R 1/025* (2013.01); *H04R 1/345* (2013.01); *H04R 1/021* (2013.01); *H04R 2201/021* (2013.01)

(58) Field of Classification Search

CPC ..... H04R 1/02

See application file for complete search history.

(56) References Cited

U.S. PATENT DOCUMENTS

| | | | |
|---|---|---|---|
| 5,734,732 | A | 3/1998 | Lemmon |
| 5,859,917 | A | 1/1999 | Silber et al. |
| 7,171,013 | B2 | 1/2007 | Kosatos et al. |
| 8,224,014 | B2 | 7/2012 | Sprinkle |
| 2004/0258269 | A1 | 12/2004 | Halsall et al. |
| 2007/0025580 | A1 | 2/2007 | Reardon et al. |
| 2007/0253304 | A1 | 11/2007 | Hsu |
| 2008/0199037 | A1 | 8/2008 | Xu et al. |
| 2008/0247593 | A1 | 10/2008 | Sprinkle |

OTHER PUBLICATIONS

Non-Final Office Action for corresponding U.S. Appl. No. 13/550,338, mailed Jun. 19, 2013, 15 pages.

Final Office Action for corresponding U.S. Appl. No. 13/550,338, mailed Mar. 11, 2014, 18 pages.

*Primary Examiner* — Matthew Eason
*Assistant Examiner* — Taunya McCarty
(74) *Attorney, Agent, or Firm* — Brooks Kushman P.C.

(57) ABSTRACT

A loudspeaker mounting assembly includes a frame, a sleeve, and a tilt-angle adjustment mechanism. The frame may include an outer frame, an inner frame rotatable about a frame axis relative to the outer frame, and a frame wall extending away from a rear side. The sleeve is coupled to the inner frame at a pivot axis and is tiltable to a plurality of tilt angles relative to the inner frame. The tilt-angle adjustment mechanism is engageable with the sleeve to enable selection of a desired tilt angle. A loudspeaker may be mounted to the sleeve such that the loudspeaker may be swiveled about the frame axis and tilted about the pivot axis.

26 Claims, 8 Drawing Sheets

LOUDSPEAKER MOUNTING ASSEMBLY

CROSS-REFERENCE TO RELATED APPLICATIONS

This application is a continuation of U.S. application Ser. No. 13/550,338 filed Jul. 16, 2012, which is a divisional of U.S. application Ser. No. 11/697,226 filed Apr. 5, 2007, now U.S. Pat. No. 8,224,014, the disclosures of which are hereby incorporated in its (their) entirety by reference herein.

TECHNICAL FIELD

This invention relates generally to mounting assemblies of the type that may be employed to support electromagnetic transducers such as loudspeakers. More particularly, the invention relates to mounting assemblies that are adjustable relative to two axes. When employed to support a loudspeaker or other transducer, a mounting assembly of this type enables adjustment of the directivity of acoustical output.

BACKGROUND

An electro-acoustical transducer such as a loudspeaker (or, more simply, a speaker) may be mounted to an assembly or frame that allows adjustment of the directivity of the loudspeaker. Such a mounting assembly is typically structured so that one or more portions of the assembly are movable relative to the other fixed portions. Typical examples of this type of mounting assembly include the well-known "eyeball" mounts and "omni-mounts," which often are utilized to mount a loudspeaker in a ceiling. Typically, the loudspeaker is housed within a frame structure of the mounting assembly, and the frame structure has an opening through which sound waves produced from the loudspeaker propagate into an intended listening area. To protect the loudspeaker, and particularly the flexible diaphragm of the loudspeaker, as well as to improve the appearance of the mounting assembly, a grille covers the opening of the frame structure.

Adjustable mounting assemblies of this type are typically adjustable between on-axis and off-axis positions. At the on-axis position, the axis of the loudspeaker is oriented in the same direction as the axis of the supporting frame, such that sound waves are at least initially directed normal to the opening of the mounting assembly and to the grille, and thus normal to the surface of a ceiling or other structure to which the mounting assembly is mounted. At the off-axis position, resulting from adjusting the movable portion of the mounting assembly, the axis of the loudspeaker is oriented at some angle relative to the axis of the supporting frame, and thus also at an angle to the ceiling or other mounting surface.

Known adjustable mounting assemblies for loudspeakers have at least two serious disadvantages. First, to allow for movement of the loudspeaker, the loudspeaker typically must be positioned at a significant distance behind the grille. This configuration ensures that the loudspeaker or the portion of the frame supporting the loudspeaker does not come into contact with the grille, and that the grille does not limit the excursions of the oscillating diaphragm of the loudspeaker during operation. Because of the distance conventionally required between the loudspeaker and the grille, sound waves produced from the loudspeaker must travel a significant distance through the confines of the mounting assembly before passing through the grille and into the listening area. Consequently, many of the sound waves are reflected off the structural components of the mounting assembly, which degrades acoustic performance. Such reflections occur even when the loudspeaker is mounted at the on-axis position, again due to the distance between the loudspeaker and the grille. Second, when the loudspeaker is adjusted so as to be directed off-axis, the loudspeaker is actually pointed into the mounting assembly, thus engendering more instances of reflections and further degrading acoustic performance.

Therefore, a need exists for a mounting assembly for a loudspeaker that enables adjustment of the directivity of the loudspeaker while minimizing the degradation of acoustic performance due to, for example, internal reflections of sound waves off the mounting assembly.

SUMMARY

According to one implementation, a loudspeaker mounting assembly includes a frame and a sleeve. The frame is annularly disposed about a frame axis and includes an outer frame and an inner frame. The inner frame is coupled to the outer frame and is rotatable about the frame axis relative to the outer frame. The sleeve is coupled to the inner frame at a pivot axis. The sleeve is movable in only a first degree of freedom and a second degree of freedom; the first degree of freedom corresponding to rotation of the sleeve with the inner frame about the frame axis, and the second degree of freedom corresponding to tilting of the sleeve about the pivot axis.

According to another implementation, a loudspeaker mounting assembly includes a first mounting structure and a second mounting structure. The first mounting structure is annularly disposed about a first axis and has a first opening lying perpendicular to the first axis. The first mounting structure includes a wall extending away from a rear side of the first mounting structure. The second mounting structure is annularly disposed about a second axis and has a second opening lying perpendicular to the second axis. The second mounting structure is coupled to the first mounting structure at a pivot axis and is tiltable about the pivot axis from an on-axis position to a maximum off-axis position away from the rear side. At the on-axis position, the second opening is located proximate to the first opening and the second axis is substantially parallel to the first axis. At the maximum off-axis position, the second axis diverges away from the wall.

According to yet another implementation, a loudspeaker mounting assembly includes a first mounting structure and a second mounting structure. The first mounting structure is annularly disposed about a first axis and has a first opening lying perpendicular to the first axis. The first mounting structure includes a wall extending away from a rear side of the first mounting structure. The second mounting structure is annularly disposed about a second axis and has a second opening lying perpendicular to the second axis. The second mounting structure is coupled to the first mounting structure at a pivot axis and is tiltable about the pivot axis from an on-axis position to a maximum off-axis position away from the rear side. At the on-axis position, the second opening is located proximate to the first opening and the second axis is substantially parallel to the first axis. At the maximum off-axis position, the second axis is substantially parallel to the wall.

According to yet another implementation, a loudspeaker mounting assembly includes a first mounting structure and a second mounting structure. The first mounting structure is annularly disposed about a first axis and has a first opening lying perpendicular to the first axis. The first mounting structure includes a first wall extending away from a rear side of the first mounting structure. The second mounting structure includes a front side, a front end at the front side that is annularly disposed about a second axis, a rear side, and a second wall extending from the front side to the rear side away from the front side. The second mounting structure is coupled to the first mounting structure at a pivot axis. The front end of the second mounting structure has a second opening lying perpendicular to the second axis. The second mounting structure is tiltable about the pivot axis from an on-axis position to a maximum off-axis position away from the rear side, and to a plurality of intermediate off-axis positions between the on-axis position and the maximum off-axis position. At the on-axis position, the second opening is located proximate to the first opening and the second axis is substantially parallel to the first axis. At any of the intermediate off-axis positions, the second axis, in a direction generally out from the front side and away from the second mounting Structure, diverges away from the first wall.

According to yet another implementation, a loudspeaker mounting assembly includes a frame, a sleeve, and a tilt-angle adjustment mechanism. The frame includes an outer frame, an inner frame rotatable about a frame axis relative to the outer frame, a front side, a rear side, and a frame wall extending away from the rear side. The sleeve is coupled to the inner frame at a pivot axis, and is tiltable about the pivot axis away from the rear side to a plurality of tilt angles relative to the inner frame. The frame wall is annularly disposed about at least a portion of the sleeve. The tilt-angle adjustment mechanism is selectively engageable with the sleeve, where each tilt angle is selectable by the tilt-angle adjustment mechanism.

Other devices, apparatus, systems, methods, features and advantages of the invention will be or will become apparent to one with skill in the art upon examination of the following figures and detailed description. It is intended that all such additional systems; methods, features and advantages be included within this description, be within the scope of the invention, and be protected by the accompanying claims.

BRIEF DESCRIPTION OF THE DRAWINGS

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
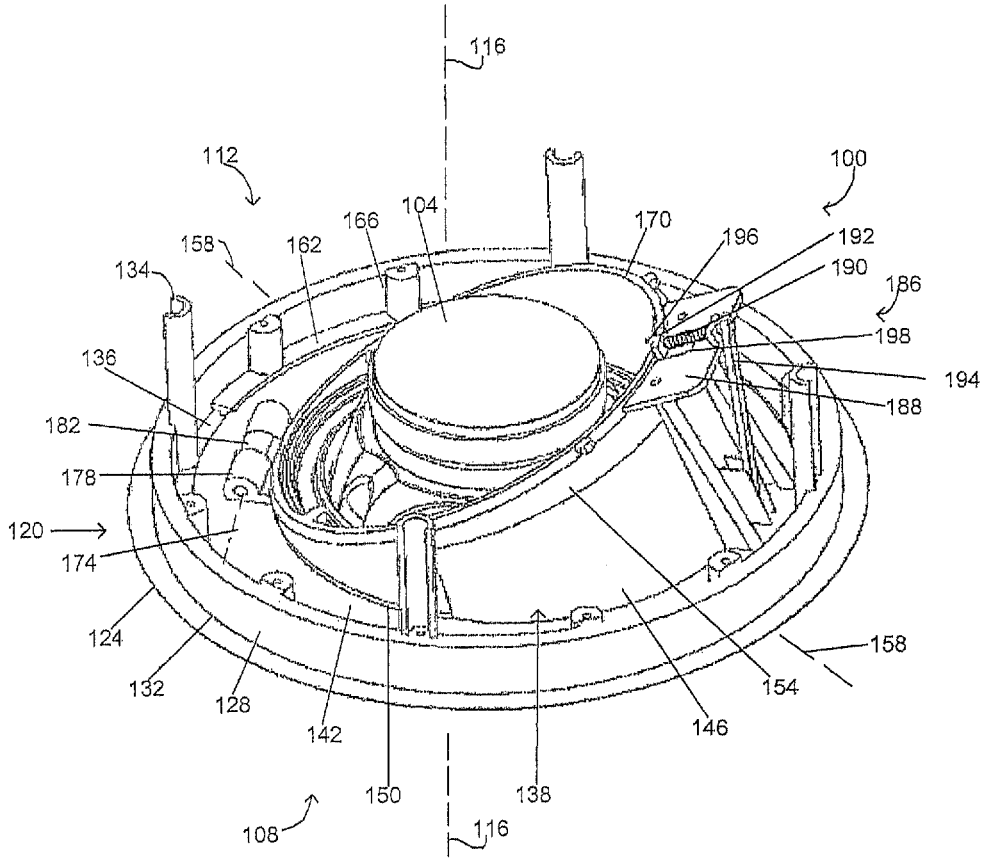
FIG. 1 is a perspective view of an example of a mounting assembly useful for mounting a loudspeaker or other type of electro-acoustical transducer to a surface.

FIG. 1 is a perspective view of an example of a mounting assembly 100 useful for mounting a loudspeaker 104 or other type of electro-acoustical transducer to any suitable mounting surface (not shown). The mounting surface may be any structure suitable for receiving the mounting assembly 100 and its associated loudspeaker 104. For example, the mounting surface may be a ceiling, a wall, a speaker cabinet or box, a housing of an audio playback device, a baffle plate, an instrument panel, a structural member of a vehicle, etc. The mounting assembly 100 in combination with the loudspeaker 104 may collectively be considered to be a loudspeaker assembly or loudspeaker system.

As a general matter, the loudspeaker 104 may be operated in any suitable listening environment such as, for example, the room of a building, a theater, or a large indoor or outdoor arena. Moreover, the loudspeaker 104 may be sized to process any desired range of the audio frequency band, such as the high-frequency range (generally 2 kHz-20 kHz) typically produced by tweeters, the midrange (generally 200 Hz-5 kHz) typically produced by midrange drivers, and the low-frequency range (generally 20 Hz-200 Hz) typically produced by woofers. In the examples provided in this description, the loudspeaker 104 may be considered as being of the direct-radiating type. However, in other alternative examples, the loudspeaker 104 may be considered as being of the compression driver type, the configuration of which is readily appreciated by persons skilled in the art. More generally, the invention being described does not require the use of any specific type of loudspeaker or other transducer.

For purposes of description, the mounting assembly 100, the loudspeaker 104, and their respective components generally have a front (or outer) side 108 and a rear (or inner) side 112 opposing the front side 108. In some examples, a mounting surface, or other structure to which the mounting assembly 100 is mounted, may be considered as a reference by which to demarcate the front side 108 from the rear side 112. The front side 108 is typically intended to face a listening area into which sound waves produced by the loudspeaker 104 are directed. The rear side 112 may correspond to an interior space to the rear of the mounting surface or some other type of space generally opposing the front of the mounting surface. It will be understood, however, that the use in this disclosure of terms such as "front," "outer," "rear" and "inner," as well as "upper," "lower," "horizontal," "vertical," and similar relative terms, is not intended to limit the mounting assembly 100, loudspeaker 104, or any of their respective components and features to any particular orientation in space.

Also for purposes of description, the mounting assembly 100 and loudspeaker 104 may be considered as being generally arranged or disposed about a central or longitudinal axis 116. The central axis 116 is typically orthogonal to the plane of the mounting surface to which the mounting assembly 100 is mounted. In the implementation illustrated in FIG. 1, the central axis 116 is also referred to as the frame axis. It will be understood, however, that the central axis 116 serves as a convenient reference only, and does not designate any particular symmetry, center of geometry, or center of mass as regards the mounting assembly 100 and loudspeaker 104 as a whole.

The mounting assembly 100 as a structure includes a frame, a portion of which is fixed in position to a suitable mounting surface and another portion of which is movable as described below. In the example illustrated in FIG. 1, the frame includes an outer frame 120. The outer frame 120 may include a base 124 and a wall 128, both of which are annularly disposed about the frame axis 116. The base 124 and the wall 128 may be integrally formed or may initially be separate elements coupled together by any suitable means. The base 124 and the wall 128 meet at an outer peripheral junction 132 where the portion of the base 124 protruding radially outwardly beyond the outer diameter of the wall 128 may serve as a mounting flange. For example, to mount the mounting assembly 100 in or to a mounting surface, a hole may be formed in the mounting surface having a diameter roughly equal to the outer diameter of the wall 128. The mounting assembly 100 may then be inserted through the hole, rear side 112 first, until the underside of the flange portion of the base 124 abuts the edge area of the mounting surface defining the hole, such that the front side 108 of the mounting assembly 100 is flush or substantially flush with mounting surface facing the listening area. To enhance the securing of the mounting assembly 100 to the mounting surface, the outer frame 120 may include one or more hollow mounting posts 134 through which appropriate fasteners such as screws may be inserted to couple the outer frame 120 with a structure inside of the mounting surface.

The outer frame 120 may also include an inside rim or flange 136 extending radially inward from the inside surface of the wall 128 toward the frame axis 116. From the perspective of FIG. 1, the inside rim 136 may be located at a greater elevation than the base 124 relative to the frame axis 116. The function of the inside rim 136 is described below.

The frame of the mounting assembly 100 may also include an inner frame 138. The inner frame 138 may include a base 142 and a wall 146. The base 142 and the wall 146 may be integrally formed or may initially be separate elements coupled together by any suitable means. The wall 146 includes an annular first end 150 located at the base 142 and generally facing the front side 108 of the mounting assembly 100, and an annular second end 154 generally facing the rear side 112 of the mounting assembly 100. The base 142 and the annular first end 150 are annularly disposed about the frame axis 116. Thus, in the present example, the frame axis 116 may be considered as being either the axis of the outer frame 120 or the axis of the annular first end 150 of the inner frame 138. The spacing or distance between the first end 150 and the second end 154 corresponds to the length (or height) of the wail 146.

In the example illustrated in FIG. 1, the length of the wall 146 of the inner frame 138 varies (increases or decreases) around the circumference of the wall 146. Hence, from the perspective of FIG. 1, the length of the wall 146 varies from a minimum value at the left side of the wall 146 to a maximum value at the right side of the wall 146. Also in the illustrated example, the plane in which the second end 154 lies is oriented at an acute angle relative to a horizontal reference plane or line (e.g., the plane of the base 142 or first end 150) or relative to a vertical reference plane or line (e.g., the frame axis 116). By this configuration, the second end 154 is annularly disposed about an axis 158 that is angled in non-parallel relation to the frame axis 116. As described more fully below, the varying length of the wall 146 and the angled orientation of the second end 154 of the wall 146 accommodate the selective tilting of the loudspeaker 104 relative to the inner frame 138 and outer frame 120.

The inner frame 138 may be coupled to or supported by the outer frame 120 by any suitable means. In some implementations, the inner frame 138 may be rotated or swiveled about the frame axis 116 relative to the outer frame 120. In such implementations, the inner frame 138 is movably coupled to the outer frame 120 by any means suitable for enabling the. inner frame 138 to be rotated or swiveled relative to the outer frame 120 while also being structurally supported by or within the outer frame 120. For example, the inner frame 138 may be secured to the outer frame 120 by a clamping, coupling or retaining device, or through any other type of engagement such that the inner frame 138 is movable about the frame axis 116, but is restricted from being translated along the frame axis 116 as well as from being rotated or translated relative to any other axis or direction. In the example illustrated in FIG. 1, the mounting assembly 100 utilizes one or more arcuate clamping or retaining members 162 to movably couple the inner frame 138 to the outer frame 120. The retaining member 162 may include one or more posts 166 with holes to enable each retaining member 162 to be secured to the outer frame 120 by means of a suitable fastener such as a screw. The retaining member 162 may constitute a plurality of arcuate segments or a single annular element.

To movably couple the inner frame 138 to the outer frame 120, the inner frame 138 may be set concentrically within the outer frame 120 such that the base 142 of the inner frame 138 is co-planar with the base 124 of the outer frame 120, or substantially co-planar with the base 124, or such that plane of the base 142 remains proximal and parallel to the base 124. In the example illustrated in FIG. 1, the base 142 of the inner frame 138 is parallel and in close proximity to the base 124 of the outer frame 120, and is co-planar with the inside rim 136 of the outer frame 120.

In this example, the retaining member 162 has a T-shaped cross-section. The vertical portion of the T-shaped cross-section of the retaining member 162 may be interposed between the outer diametrical edge of the base 142 of the inner frame 138 and the inner diametrical edge of the base 124 (or, in the specific example, the inside rim 136) of the outer, frame 120. Alternatively, the vertical portion of the retaining member 162 may be inserted into a complementary recess (not shown) formed in either the outer frame 120 or the inner frame 138, thus minimizing any tolerance between the outer diametrical edge of the base 142 and the inner diametrical edge of the base 124. The underside of the horizontal section of the T-shaped cross-section of the retaining member 162 may abut the top side of the base 142 of the inner frame 138 or may be separated by a small tolerance from the base 142. In either case, at least a portion of the horizontal section of the retaining member 162 is located in overlapping relation to the base 142 of the inner frame 138. Also in either case, the frictional contact (if any) between the coupling member 162 and the base 142 is low enough to permit the rotational or swiveling movement of the inner frame 138 about the frame axis 116 while preventing other types of movement of the inner frame 138. For example, the retaining member 162 is positioned to prevent the inner frame 138 from being rotated or tilted about any axis perpendicular to the frame axis 116, and thus the base 142 remains in a coplanar or at least a parallel relation to the base 124 while the inner frame 138 is swiveled about the frame axis 116. The underside (front side) of the base 142 of the inner frame 138 may be supported by one or more shims or spacer members (not shown) that are in turn supported by the rear side of the base 124 of the outer frame 120.

The mounting assembly 100 may also include an additional mounting structure in tile form of an enclosure or housing such as a sleeve 170 surrounding the loudspeaker 104. The sleeve 170, or at least a portion of the sleeve 170, is in turn surrounded by the wall 146 of the inner frame 138. The sleeve 170 may be movably coupled to the inner frame 138 by any means suitable for enabling the sleeve 170 to be tilted relative to the inner frame 138 while also being structurally supported by or within the inner frame 138. For example, the sleeve 170 may be pivotably coupled to the inner frame 138. In the example illustrated in FIG. 1, the sleeve 170 is pivotably coupled to the inner frame 138 at a pivot axis 174. The pivot axis 174 may be located at a radial distance from the frame axis 116 in a plane generally orthogonal to the frame axis 116. The pivot axis 174 may also be parallel or co-incident with the above-noted horizontal reference plane or line associated with the plane of the base 142 of the inner frame 138. In addition, to accommodate selective tilting of the loudspeaker 104 and sleeve 170 relative to the inner frame 138 and outer frame 120, the pivot axis 174 may be located at the side of the inner frame 138 where the length of the wall 146 of the inner frame 138 is at a minimum. In the illustrated implementation, the loudspeaker 104 is attached to or supported by the sleeve 170 by any suitable means such that the loudspeaker 104 and sleeve 170 move together as a unit.

In the example specifically illustrated in FIG. 1, the pivot axis 174 is realized by providing a pivot device such as a hinge that includes a first hinge portion 178 and a second hinge portion 182. One hinge portion 178 or 182 may be provided as part of the inner frame 138 (integrally formed, or separate but coupled, with the inner frame 138) and the other hinge portion 182 or 178 may be provided as part of the sleeve 162 (integrally formed, or separate but coupled, with the sleeve 162). The hinge portions 178 and 182 have respective bores that are aligned with each other along the pivot axis 174. In one example, formation of the hinge may be completed by inserting a pin (not shown) or like elongated component through the bores of the hinge portions 178 and 182 along the pivot axis 174. The above-noted parallel spacing between the base 142 of the inner frame 138 and the base 124 of the outer frame 120 may be desirable for providing clearance for the movable hinge portion 182. It will be understood that devices other than hinged configurations may alternatively be provided for enabling the pivoting motion.

Figure 7:
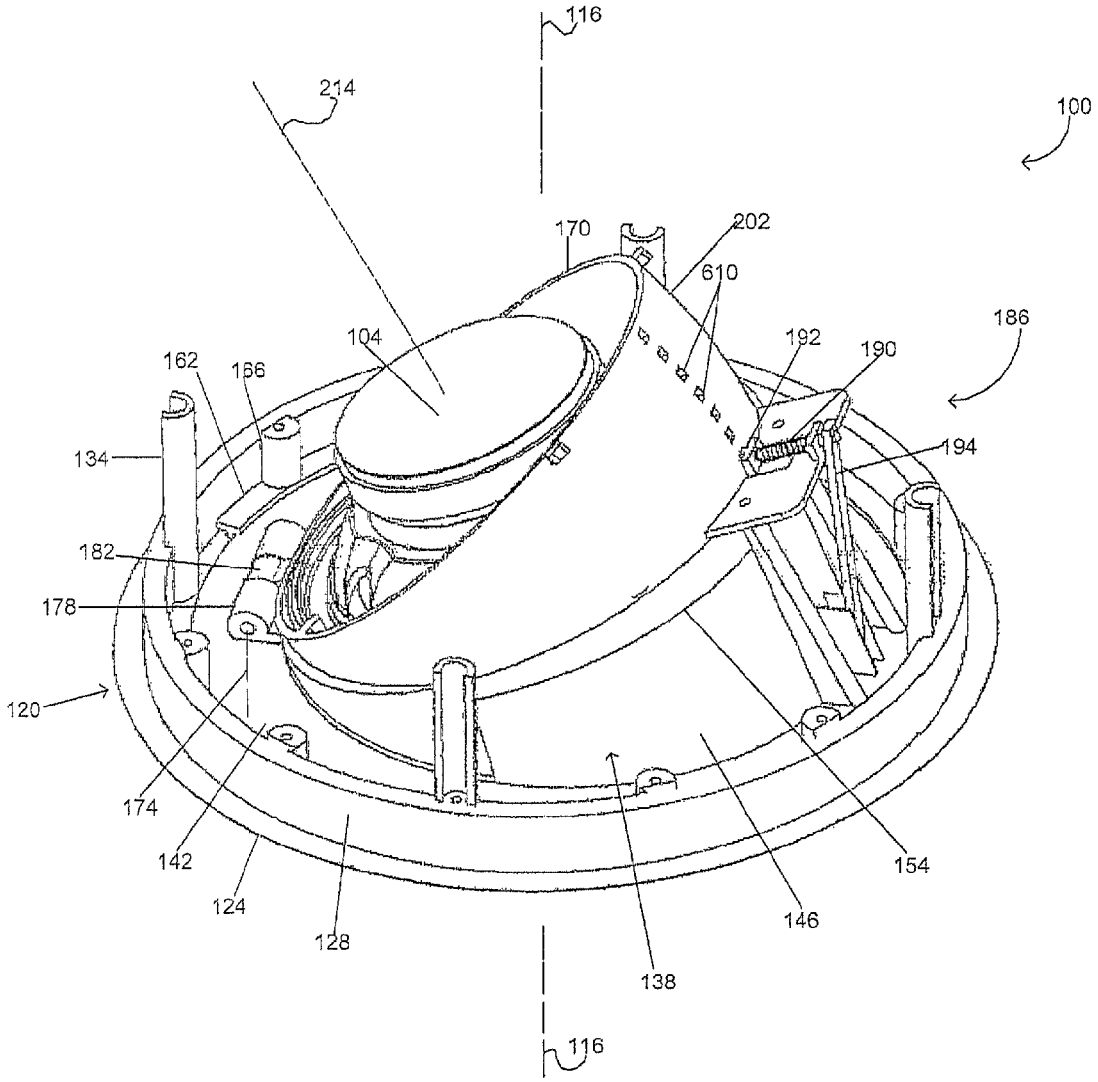
FIG. 7 is a perspective view of the mounting assembly illustrated in FIG. 1, tilted to a maximum off-axis position.
Figure 8:
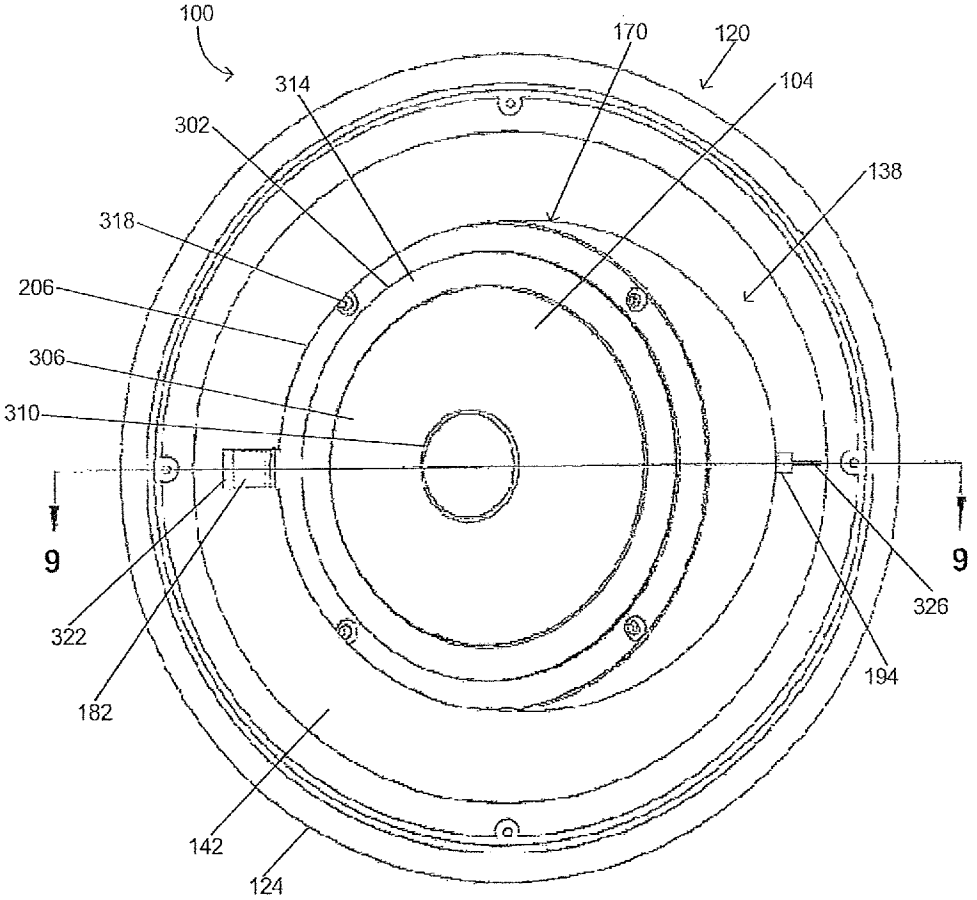
FIG. 8 is a front plan view of the mounting assembly illustrated in FIG. 6.
Figure 9:
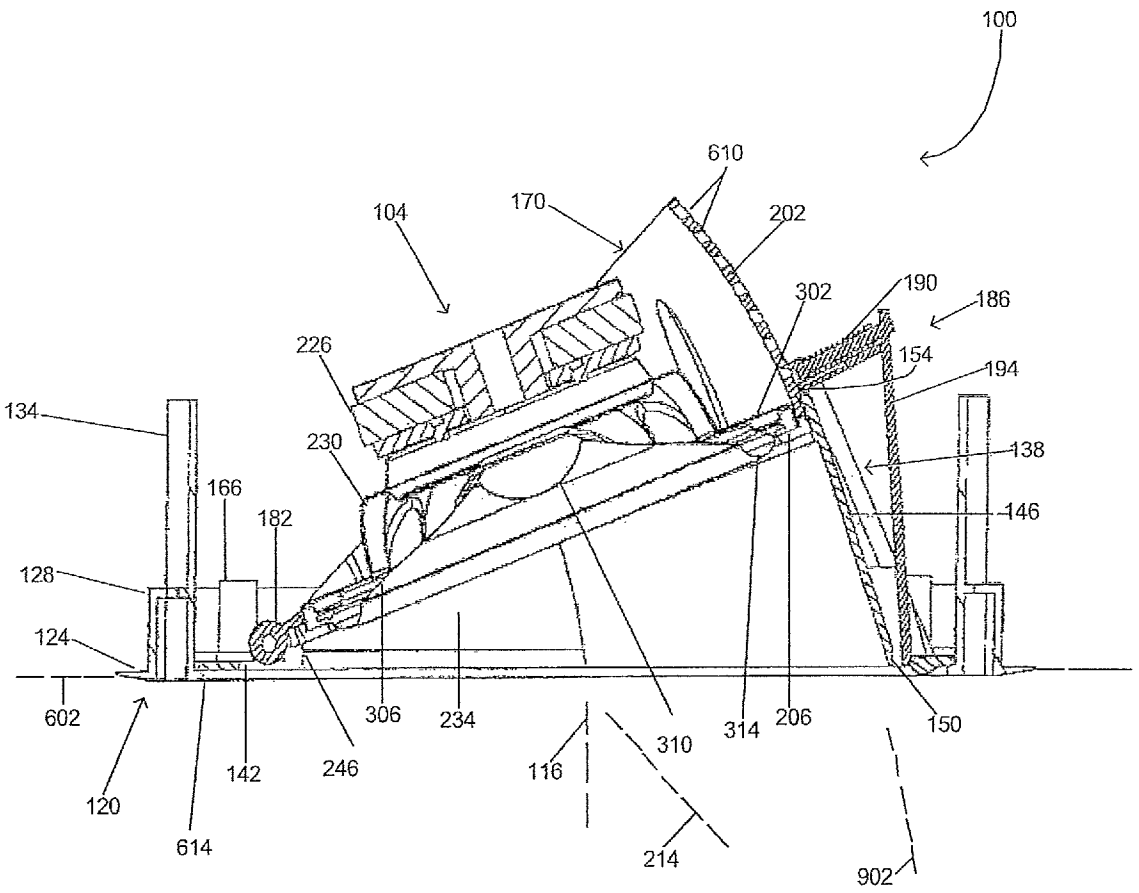
FIG. 9 is a side elevation cross-sectional view of the mounting assembly illustrated in FIG. 7, taken along line 9-9 of FIG. 8.

The mounting assembly 100 may also include a means, device, or mechanism for adjusting the tilt angle of the sleeve 170, and thus the loudspeaker 104, relative to the frame axis 116 from an on-axis position, through one or more intermediate off-axis positions, and to a maximum off-axis position. The on-axis position of the mounting assembly 100 is illustrated in FIGS. 1 and 3-6, and the maximum off-axis position (described below) is illustrated in FIGS. 7-9. In some implementations, the tilt-angle adjusting means may be structured to allow an essentially infinite number of tilt angles to be selected between the on-axis position and the maximum off-axis position. For example, the tilt-angle adjusting means may provide for frictional yet movable contact between the sleeve 170 and the wall 146 or other portion of the inner frame 138. In other implementations, the tilt-angle adjusting means is structured to allow a finite number of tilt angles to be selected, i.e., incremental adjustment.

By way of example, as illustrated in FIG. 1, mounting assembly 100 includes a tilt-angle adjustment device 186. The tilt-angle adjustment device 186 may include a mounting bracket 188 affixed to the inner frame 138, an adjusting pin 190, an end member 192, and an elongated member 194. The adjusting pin 190 is supported in a hole of the mounting bracket 188 and may be spring-loaded as illustrated in FIG. 1. The end member 192 is attached to one end of the adjusting pin 190 and includes a protrusion 196. The end member 192 is movable with the adjusting pin 190 in a direction toward and away from the sleeve 170. As described below, the sleeve 170 may include a series of notches or recesses in which the end member 192 (and particularly the protrusion 196 if provided) may come into engagement. When the adjusting pin 190 is spring-loaded, this engagement is spring-biased. The end member 192 may travel in a recess 198 formed in the mounting bracket 188 to guide the reciprocal movement of the end member 192. The elongated member 194 at one end is coupled to the head of the adjusting pin 190 and may be pivotally coupled to a section of the inner frame 138 (not specifically shown). The elongated member 194 may be grasped to facilitate movement of the adjusting pin 190 and thus selection of a desired tilt angle, as well as to facilitate swiveling of the sleeve 170 and loudspeaker 104 about the frame axis 116, as described below.

It will be understood that tilt-angle adjustment devices having other configurations may alternatively be provided. For example, a configuration utilizing a worm and worm gear could be provided.

Figure 2:
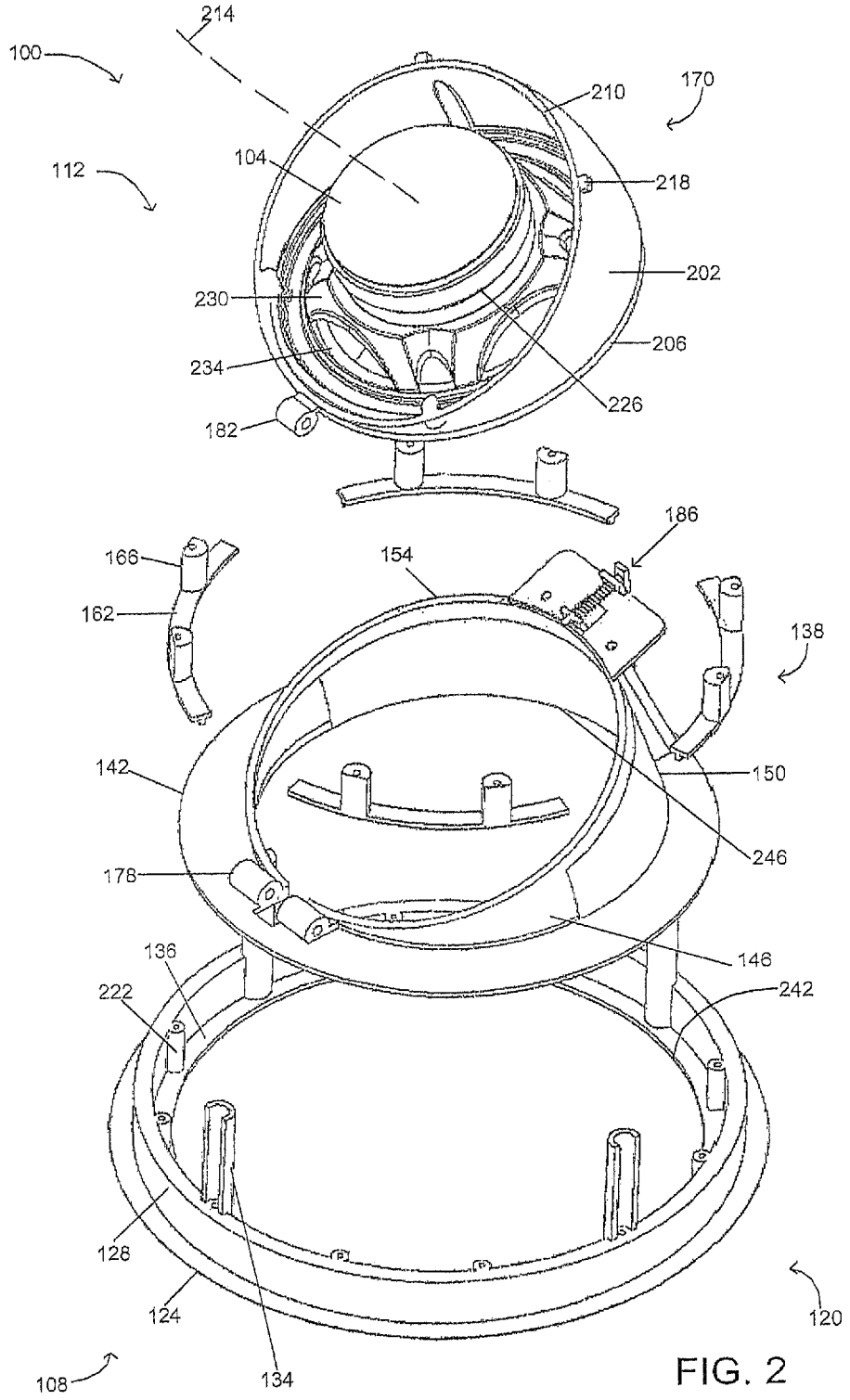
FIG. 2 is an exploded perspective view of the mounting assembly illustrated in FIG. 1.

FIG. 2 is an exploded perspective view of the mounting assembly 100 and illustrates additional features or details. The sleeve 170 may include a wall 202. The wail 202 includes an annular first end 206 generally facing the front side 108 of the mounting assembly 100, and an annular second end 210 generally facing the rear side 112 of the mounting assembly 100. The first end 206 is annularly disposed about a sleeve axis 214. At the on-axis position of the mounting assembly 100 illustrated in FIG. 1, the first end 206 of the sleeve 170 is annularly disposed about the frame axis 116, as in the case of the fixed-position outer frame. 120 and the second end 154 of the inner frame 138. In a case where the on-axis position corresponds to a zero-degree tilt angle, the sleeve axis 214 is thus parallel with the frame axis 116 at the on-axis position. Depending on the position of the sleeve 170 relative to other portions of the mounting assembly 100, the sleeve axis 214 may also be coincident with the frame axis 116 at the on-axis position. Also at the on-axis position, the second end 210 of the sleeve 170 is annularly disposed about an axis oriented at an angle to the frame axis 116 and the sleeve axis 214. The axis of the second end 210 may be coincident or substantially coincident with the axis 158 illustrated in FIG. 1.

The sleeve 170 may include one or more tabs or protrusions 218 extending outward from the wall 202 at the second end 210. These protrusions 218 may serve as stop members that abut against the second end 154 of the inner frame 138, thus preventing the sleeve 170 from being tilted below the on-axis position illustrated in FIG. 1.

As also illustrated in FIG. 2, the spacing or distance between the first end 206 of the sleeve 170 and the second end 210 of the sleeve 170 corresponds to the length (or height) of the wall 202. At least a section of the wall 146 of the inner frame 138 may be shaped complementarily with the wall 202 of the sleeve 170. Moreover, the two walls 146 and 202 may be provided as nested toroidal sections. Thus, in the example illustrated in FIG. 2, the length of the wall 202 varies (increases or decreases) around the circumference of the wall 202. From the perspective of FIG. 2, the length of the wall 202 varies from a minimum value at one side of the wall 202 (in the present example, where the hinge portion 182 is located) to a maximum value at the opposite side of the wall 202. Also in the illustrated example, the wall 202 is oriented at an acute angle relative to the plane in which the first end 206 is located. By this configuration, the plane in which the second end 210 is located is angled in non-parallel relation to the plane in which the first end 206 is located. The varying length of the wall 202 of the sleeve 170 and the angled orientation of the wall 202 accommodate the similar configuration of the wail 146 of the inner frame 138 and the selective tilting of the loudspeaker 104 relative to the inner frame 138 and outer frame 120.

As further illustrated in FIG. 2, the outer frame 120 may include one or more posts 222 extending upward from the inside rim 136 of the outer frame 120 along the inside diameter of the wall 128 of the outer frame 120, with each post 222 having a hole. The posts 166 of the coupling member(s) 162 may be hollow and sized to fit around the corresponding posts 222 of the outer frame 120. By this configuration, the coupling member(s) 162 may be placed onto the outer frame 120 such that the respective holes of corresponding pairs of posts 166 and 222 are aligned, thus enabling each coupling member 162 to be secured to the outer frame 120 by means of a suitable fastener such as a screw.

FIG. 2 also illustrates details of the rear side of an example of the loudspeaker 104, which is mounted within the sleeve 170 by any suitable means. As appreciated by persons skilled in the art, the loudspeaker 104 may include a magnet assembly 226 of an electromagnetic transducer or driver attached to a speaker frame 230. The speaker frame 230 may be of the illustrated basket type. The speaker frame 230 typically supports the outer periphery of a flexible suspension member, and a diaphragm 234 is attached to the inner periphery of the suspension member such that the diaphragm 234 spans the open front end of the speaker frame 230. As appreciated by persons skilled in the art, the diaphragm 234 may be any structure that may be attached to or suspended by the speaker frame 230 in a manner that secures the diaphragm 234 while permitting at least a portion of the diaphragm 234 to move in a reciprocating or oscillating manner. Typically, the diaphragm 234 is cone-shaped or dome-shaped and is constructed from any suitably stiff material. The diaphragm 234 may be attached to the speaker frame 230 through one or more suspension members (not specifically shown) such as a surround and/or a spider. The loudspeaker 104 may further include one or more electrically conductive coils (e.g., voice coils, not shown) attached to the diaphragm 234 either directly or via an intermediate element such as a coil former or bobbin (not shown). The coil is typically disposed in an annular air gap formed by the magnet assembly 226 and is immersed in the permanent magnetic field established by the magnet assembly 226. As appreciated by persons skilled in the art, the coil produces a magnetic field of alternating polarity in response to receiving AC signals from an audio source. Due to the electro-dynamic coupling between the coil and the permanent magnetic field provided by the magnet assembly 226, the coil is actuated to reciprocate within the air gap. Due to the attachment between the coil and the diaphragm 234, the diaphragm 234 produces sound waves that radiate out from the front side 108 of the loudspeaker 104. Generally, the features and operation of various types of loudspeakers are known to persons skilled in the art and thus need not be described further.

As further illustrated in FIG. 2, the outer frame 120 has an opening 242 lying in the plane of the base 124 of the outer frame 120 and thus perpendicular or orthogonal to the frame axis 116 (FIG. 1). The frame axis 116 may be centered relative to the opening 242. The opening 242 accommodates the use of the inner frame 138 and sleeve 170 in conjunction with the loudspeaker 104. A grille, screen, or tile like (not shown) may be attached to the outer frame 120 so as to span the opening 242. Likewise, the inner frame 138 has an opening 246 lying in the plane of the base 142 and first end 150 of the inner frame 138. The opening 246 of the inner frame 138 may also be perpendicular to the frame axis 116, and the frame axis 116 may also be centered relative to the opening 246. The diameter of the opening of the inner frame 138 may be about the same as, or somewhat less than, the diameter of the wall 146 of the inner frame 138. The diameter of the wall 146 is large enough to circumscribe all or a portion of the sleeve 170 and to accommodate adjustment of the sleeve 170 through and to all available tilt angles. In addition, the sleeve 170 has an opening (not shown) at its first end 206 that is perpendicular to the sleeve axis 214.

The loudspeaker 104 may be considered as having an axis. The axis of the loudspeaker 104 may be considered as corresponding to the general direction along which sound energy produced by the diaphragm 234 is radiated. In the case where the loudspeaker 104 is centrally fixed within the opening of the first end 206 of the sleeve 170, the axis of the loudspeaker 104 generally corresponds to the illustrated sleeve axis 21.4. The loudspeaker 104 is supported in the sleeve 170 such that the position of the diaphragm 234 is fixed relative to the first end 206 of the sleeve 170. Thus, sound energy radiates outward through the opening of the first end 206 of the sleeve 170 in the same direction at any tilt angle to which the loudspeaker 104 and sleeve 170 are adjusted. The sound energy also radiates outward through the opening 246 of the inner frame 138, passing through a grille (if provided) at the opening 242 of the outer frame 120 and into the listening area. At off-axis tilt angles, the axis of the loudspeaker 104 is oriented at an angle to the frame axis i 16 (FIG. 1) associated with the openings 242 and 246. However, as will become more evident from the ensuing description, the mounting assembly 100 is configured to minimize degradation of the acoustical properties of the sound energy (such as due to reflections) resulting from operating the loudspeaker 104 at off-axis positions.

Figure 4:
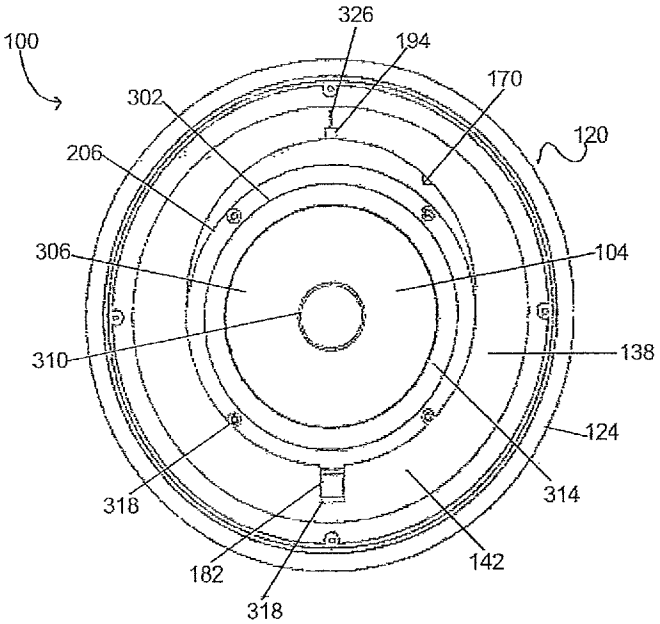
FIG. 4 is another front plan view of the mounting assembly illustrated in FIG. 1, swiveled 90 degrees in comparison to FIG. 3.
Figure 3:
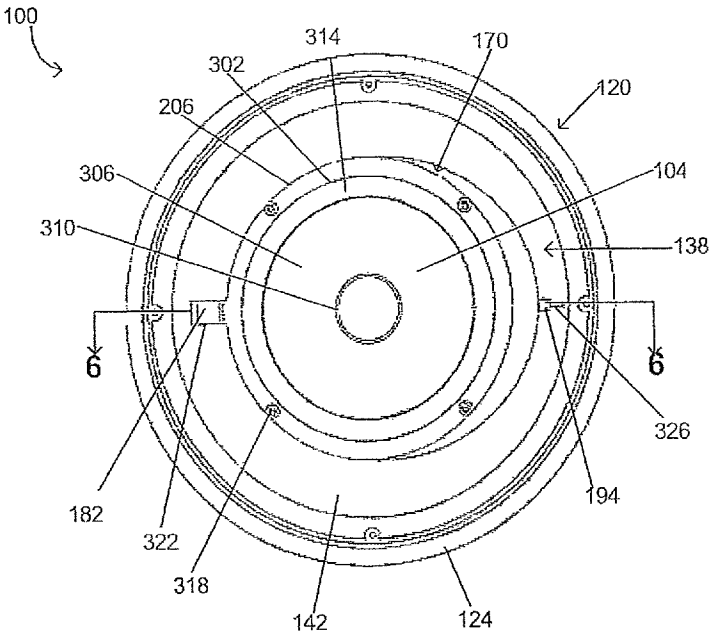
FIG. 3 is a front plan view of the mounting assembly illustrated in FIG. 1.
Figure 5:
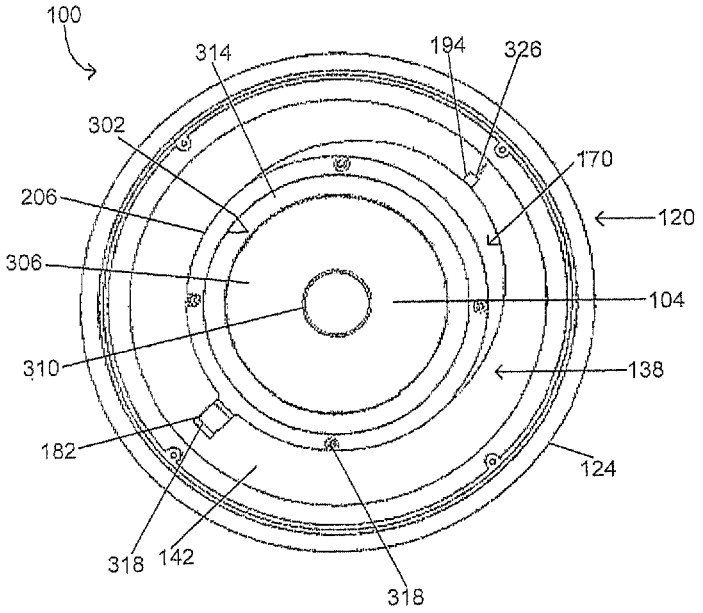
FIG. 5 is another front plan view of the mounting assembly illustrated in FIG. 1, swiveled 45 degrees in comparison to FIGS. 3 and 4.

FIGS. 3-5 are plan views of the mounting assembly 100 and loudspeaker 104 from the perspective of the front side 108 (FIG. 1). Each of FIGS. 3-5 illustrates the mounting assembly 100 and loudspeaker 104 at the on-axis position illustrated in FIG. 1, but at different rotational positions about the frame axis 116 (FIG. 1) as a result of swiveling the inner frame 138 relative to the outer frame 120. Specifically, the loudspeaker 104 shown in FIG. 4 is rotated 90 degrees from the loudspeaker 104 shown in FIG. 3, and the loudspeaker 104 shown in FIG. 5 is rotated 45 degrees from the loudspeaker 104 shown in FIGS. 3 and 4. The relative positions of the loudspeaker 104 in FIGS. 3-5 are evident by comparing the location of the hinge portion 182 in each of FIGS. 3-5. As illustrated in FIG. 1, the on-axis position may correspond to a 0-degree tilt angle at which the axis of the loudspeaker 104 is coincident or at least parallel with the frame axis 116. Thus, at the on-axis position, the swiveling of the loudspeaker 104 about the frame axis 116 may not have an appreciable effect of the directivity of the loudspeaker 104. It can be seen, however, that the swiveling of the loudspeaker 104 while the loudspeaker 104 is set to at any off-axis, tilted position would cause a distinct change in directivity.

As also illustrated in FIGS. 3-5, the sleeve 170 has an opening 302 at its first end 206, which opening 302 was described above in connection with FIG. 2 but not specifically shown in FIG. 2. A front surface 306 of the diaphragm 234 (FIG. 2) of the loudspeaker 104 and an optional dust cover or cap 310 are visible through the opening 302 of the sleeve 170. An outer periphery 314 of the diaphragm 234 is attached to the first end 206 of the sleeve 170 by any suitable means such as fastening elements 318 (e.g., screws or bolts). In some implementations, a grille (not shown), or other protective covering that would not impair sound transmission, is mounted to front of the mounting assembly 100 so as to span the various openings of the mounting assembly 100 as noted previously.

As also illustrated in FIGS. 3-5, the base 142 of the inner frame 138 may include a recess or cut-out section 322 through which the movable hinge portion 182 protrudes to accommodate the rotational movement of the hinge portion 182 about the pivot axis 174 (FIG. 1). The recess 322 is useful in conjunction with the implementation described above in which the base 142 of the inner frame 138 is parallel with but spaced from the base 124 of the outer frame 120.

As further illustrated in FIGS. 3-5, the base 142 of the inner frame 138 may include another narrow recess or slot 326 located opposite to the first recess 322 and extending in a direction radial to the frame axis 116 (FIG. 1). A portion of the elongated member 194 of the tilt-angle adjustment device 186 (FIG. 1) travels in the slot 326, and a tip of the elongated member 194 protrudes out from the slot 326. The tip of the elongated member 194 may be grasped and employed to swivel the inner frame 138 (and thus also the sleeve 170 and loudspeaker 104) about the frame axis 116. In addition, the tip of the elongated member 194 may be grasped and moved along the slot 326 to pivot the other end of the elongated member 194 that is connected to the adjustment pin 190 (FIG. 1), and is thus useful for adjusting the tilt angle of the sleeve 170 and loudspeaker 104 about the pivot axis 174 (FIG. 1).

Figure 6:
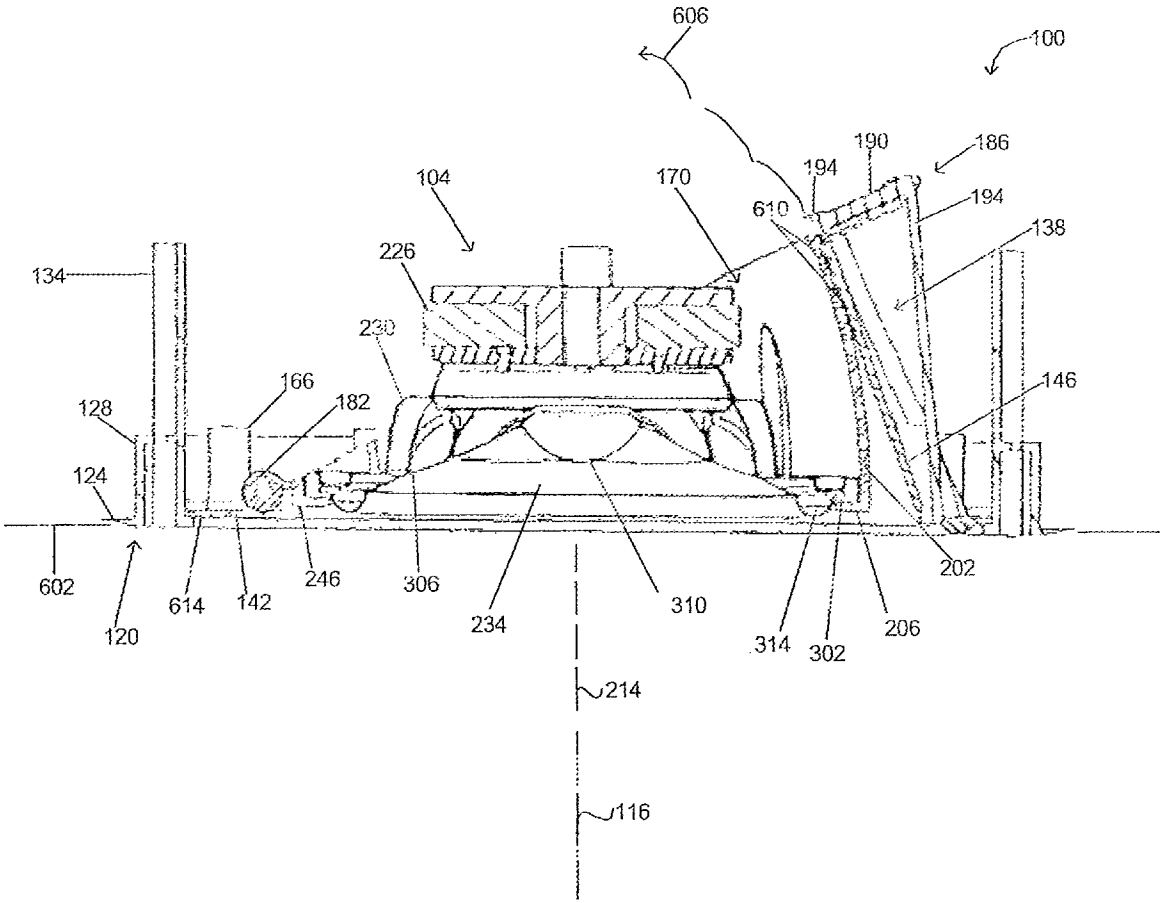
FIG. 6 is a side elevation cross-sectional view of the mounting assembly illustrated in FIG. 1, taken along line 6-6 of FIG. 3.

FIG. 6 is a side elevation cross-sectional view of the mounting assembly 100 and loudspeaker 104, taken along line 6-6 of FIG. 3. Like FIGS. 1 and 3-5, FIG. 6 illustrates the mounting assembly 100 and loudspeaker 104 in the on-axis position. The front surface of the base 124 of the outer frame 120 lies along a horizontal plane that may be referred to as the outer or front plane 602 of the mounting assembly 100. The front plane 602 is orthogonal to the frame axis 116. The front surface of the base 142 of the inner frame 138 lies in a plane parallel and in close proximity with the front plane 602. As previously noted, at the on-axis position, the sleeve axis 214 and the axis of the loudspeaker 104—generally corresponding to the directivity of sound propagation~is coincident or nearly coincident with the frame axis 116. In accordance with an aspect of the invention, the mounting assembly 100 is configured such that, at the on-axis position, the diaphragm 234 and the first end 206 (and opening 302) of the sleeve 170 may be positioned at a minimized distance behind the front plane 602. Thus, at the on-axis position, the diaphragm 234 is located as close as possible to the opening 246 of the inner frame 138 and to the front plane 602 and, consequently, as close as possible to any grille (not shown) spanning the opening 246 of the inner frame 138 without encountering any mechanical interference due to the excursions of the diaphragm 234. This configuration significantly reduces reflections from the mounting assembly 100 while the loudspeaker 104 is operating at the on-axis position.

FIG. 6 also illustrates the physical relationship between the wall 202 of the sleeve 170 and the wall 146 of the inner frame 138, as well as the cross-sectional profiles of these walls 202 and 146. The walls 202 and 146 are configured to facilitate the adjustable tilting of the loudspeaker 104 from the on-axis position illustrated in FIG. 6 to selected off-axis positions, as generally depicted by a curved arrow 606. As previously noted, the wall 146 of the inner frame 138 is oriented at an angle to either the frame axis 116 or the front plane 602. In addition, the wall 146 is conical such that from the perspective of FIG. 6 the profile of the wall 146 appears flat or straight. On the other hand, the wall 202 of the sleeve 170 is curved. In addition, the wall 202 of the sleeve 170 is positioned relative to the wall 146 of the inner frame 138 such that the radial distance of the wall 202 at the front end 206 to the frame axis 116 is less than the radial distance of the wall 146 to the frame axis 116 at any tilt angle. This configuration ensures that the wall 146 does not obstruct the wall 202 while the tilt angle of the sleeve 170 and loudspeaker 104 is being adjusted along the direction 606.

As also illustrated in FIG. 6, a series of recesses 610 are formed in the wall 202 of the sleeve 170. The recesses 610 may be through-bores as illustrated, or may be blind bores or otherwise configured to receive the protrusion 194 of the adjusting pin 190 in a lockable yet releasable manner. The number of recesses 610 and spacing between recesses 610 may be selected in accordance with the range and increments of tilt angles desired. In the illustrated example, seven recesses 610 are provided although it will be understood that more or less recesses 610 may be provided. Also by way of example, at the on-axis, 0-degree tilt-angle position, the end member 192 may abut the top of the wall 202 instead of protrude through a recess 610.

FIG. 6 also illustrates a shim or spacer member 614. A single spacer member 614, or a plurality of circumferentially spaced spacer members 614, may be interposed between the base 124 of the outer frame 120 and the base 142 of the inner frame 138. In cooperation with the coupling or clamping mechanism 162 (FIG. 1), the spacer member 614 may be utilized to set the inner frame 138 in position relative to the outer frame 120 while allowing the inner frame 138 to be swiveled about the frame axis 116.

As will become more evident from the description below and subsequent drawing figures, the configuration of the sleeve 170 and the inner frame 138, including their respective wails 202 and 146, also ensures that the axis of the loudspeaker 104, in the direction along which sound radiates toward a listening area (e.g., out from the front plane 602), does not intersect with the wall 146 of the inner frame 138 at any off-axis position of the loudspeaker 104. At the maximum off-axis position, the axis of the loudspeaker 104 may diverge away from the wall 146, or may even be parallel or substantially parallel with the wall 146, but in either case does not intersect the wall 146. Accordingly, at any tilt angle of the mounting assembly 100—e.g., the on-axis position, the maximum off-axis position, or any intermediate off-axis position the loudspeaker 104 is never pointed in the direction of (or directly toward) the wall 146 or any other structural component of the mounting assembly 100. This advantage is facilitated by design of the mounting assembly 100, which restricts all possible movement of the sleeve 170, and thus the loudspeaker 104, to only two degrees of freedom, one degree being the swiveling or rotating about the frame axis 116 and the other degree being the pivoting or tilting about the pivot axis 174 (FIG. 1). Therefore, the mounting assembly 100 is configured to significantly reduce reflections from the mounting assembly 100 while the loudspeaker 104 is operating at the off-axis positions as well as at the on-axis position.

FIG. 7 is a perspective view of the mounting assembly 100 at the maximum off-axis position. At this position, the end member 192 of the adjusting pin 190 engages the lowest recess 610 of the wall 202 of the sleeve 170. The wall 202 protrudes out from the inner frame 138, and specifically out from the second end 154 of the wall 146, to a fullest extent. In comparison to the on-axis position illustrated in FIGS. 1 and 6, at the maximum off-axis position illustrated in FIG. 7, and at any intermediate off-axis position, the axis of the loudspeaker 104 (again taken to be coincident or nearly coincident with the sleeve axis 214) is angled relative to the frame axis 116.

FIG. 8 is a plan view of the mounting assembly 100 and loudspeaker 104 from the perspective of the front side 108 (FIG. 1), but at the maximum off-axis position illustrated in FIG. 7. In comparison to the on-axis position illustrated in FIGS. 3-5, at the maximum off-axis position illustrated in FIG. 8, and at any intermediate off-axis position, the directivity of the loudspeaker 104 is tilted to the right of the drawing sheet. It can be seen that the directivity of the loudspeaker 104 at any off-axis position may be further modified by swiveling the loudspeaker 104 to a desired rotated position about the frame axis 116 (FIG. 7), such as the positions shown in FIGS. 4 and 5.

FIG. 9 is a side elevation cross-sectional view of the mounting assembly 100 illustrated in FIG. 7, taken along line 9-9 of FIG. 8. Like FIGS. 7 and 8, FIG. 9 illustrates the mounting assembly 100 and loudspeaker 104 in the maximum off-axis position. As previously noted with reference to FIG. 2, the frame wall 146 extends between a first end 150 near the front plane 602 of the mounting assembly 100 and a second end 154. Conceptually, the cross-section of the frame wall 146 that defines the boundaries of the first end 150 may be extended beyond the front plane 602 in the direction of a listening area, as depicted by a projection line 902. FIG. 9 also illustrates the portion of the loudspeaker axis (again taken to be the sleeve axis 214) that projects out from the front plane 602 in the direction of the listening area. At the maximum off-axis position, the loudspeaker axis or sleeve axis 214 may be parallel or substantially parallel to the frame wall 146 and its projection line 902. As the tilt angle is reduced to intermediate off-axis positions, the loudspeaker axis or sleeve axis 214 diverges away from the frame wall 146 and its projection line 902. With each reduction in the tilt angle, the angle between the loudspeaker axis or sleeve axis 214 and the frame wall 146/projection line 902 increases, while the angle between the loudspeaker axis or sleeve axis 214 and the frame axis 116 decreases. Eventually, at the smallest possible tilt angle—which in the illustrated example corresponds to the zero-tilt angle or on-axis position illustrated in FIG. 6—the loudspeaker axis or sleeve axis 214 becomes parallel with (and, if centered, coincident with) the frame axis 116 as shown in FIG. 6.

In another implementation, the tilt angle at the maximum off-axis position is such that, as in the case of the intermediate off-axis positions, the loudspeaker axis or sleeve axis 214 diverges away from the frame wall 146 and its projection line 902. That is, in this implementation, the tilt angle at the maximum off-axis position is not large enough to bring the loudspeaker axis or sleeve axis 214 into parallelism or substantial parallelism with the frame wall 146 and its projection line 902.

It thus can be seen that at all points in front of the opening 302 at the front end 206 of the sleeve 170, from which sound waves are directed out from the mounting assembly 100 and into a listening area, the loudspeaker axis or sleeve axis 214 does not intersect the frame wall 146 or its projection line 902 at any tilt angle of the sleeve 170 and loudspeaker 104. More generally, at any tilt angle, the axis of the loudspeaker 104 remains directed toward the listening area and not toward any structural component or framework of the mounting assembly 100. It thus can be seen that the configuration of the mounting assembly 100 significantly minimizes reflections from the mounting assembly 100 at any tilt angle.

It can also be seen that the mounting assembly 100 is structured such that, at any tilt angle, no component of the mounting assembly 100 or the loudspeaker 104 breaks the front plane 602, i.e., all movable components remain entirely positioned behind (or inside of) the front plane 602. Thus, this configuration does not require components to protrude from the front of the mounting assembly 100. Consequently, the configuration allows the mounting assembly 100 and loudspeaker 104 to remain flush with a mounting surface, and likewise accommodates the use of a low-profile grille without the risk of mechanical interference.

It can further be seen that because the sleeve 170 is coaxially positioned closer to the frame axis 116 than is the frame wall 146, and because of the curvature of the sleeve 170, the first end 206 of the sleeve 170 is closer to the frame axis 116 than is the second end 154 of the frame wall 146, at any tilt angle. This configuration ensures that the sleeve 170 may be tilted to any desired tilt angle without interference from the frame wall 146 or any other portion of the inner frame 136 and outer frame 120.

It will be noted that the tilt angle in at least some implementations may be defined as the angle between the loudspeaker axis or sleeve axis 214 and the frame axis 116. This angle may be equivalent to the angle between the front plane 602 and the plane in which the opening 302 at the front end 206 of the sleeve 170 lies or, more generally, the angle between the sleeve 170 and the frame structure of the mounting assembly 100 that is fixed in position.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A loudspeaker mounting assembly, comprising:

a first mounting structure annularly disposed about a first axis and having a first opening lying perpendicular to the first axis, the first mounting structure including a first wall extending away from a rear side of the first mounting structure;

a second mounting structure annularly disposed about a second axis and having a second opening lying perpendicular to the second axis, the second mounting structure coupled to the first mounting structure at a pivot axis and tiltable about the pivot axis from an on-axis position to a maximum off-axis position away from the rear side, the second mounting structure including a second wall defining an opening therethrough, where the pivot axis is radially displaced from the first axis and where:

at the on-axis position, the second opening is located proximate to the first opening and the second axis is substantially parallel to the first axis;

at the maximum off-axis position, the second axis diverges away from the first wall and the second wall being tiltable about the pivot axis in relation to the first wall; and an overall length of the first wall varies from a minimum value at a first position on the first wall to a maximum value at a second position on the first wall.

2. The loudspeaker mounting assembly of claim 1, where a loudspeaker is coupled to the second mounting structure and tiltable with the second mounting structure about the pivot axis.

3. The loudspeaker mounting assembly of claim 2, where the loudspeaker includes a diaphragm, the diaphragm includes a front surface generally aligned with the second opening relative to the second axis, and the front surface includes an outer periphery located proximate to the second opening.

4. The loudspeaker mounting assembly of claim 1, where the first mounting structure includes an outer frame and an inner frame coupled to the outer frame, and the inner frame is annularly disposed about the first axis and rotatable about the first axis relative to the outer frame.

5. The loudspeaker mounting assembly of claim 4, further including a retainer device positioned in overlapping relation to the inner frame to prevent the inner frame from tilting relative to the outer frame.

6. The loudspeaker mounting assembly of claim 5, further including a first hinge portion and a second hinge portion, where the first hinge portion is attached to the first mounting structure and is generally located at the pivot axis, and the second hinge portion is attached to the second mounting structure and is generally located at the pivot axis.

7. The loudspeaker mounting assembly of claim 1, further including a coupling device coupling the second mounting structure to the first mounting structure at the pivot axis.

8. The loudspeaker mounting assembly of claim 1, further including a tilt-angle adjustment mechanism selectively engaging the second mounting structure, where the second mounting structure is tiltable about the pivot axis through a plurality of tilt angles between the second mounting structure and the first mounting structure, each tilt angle being selectable by the tilt-angle adjustment mechanism.

9. The loudspeaker mounting assembly of claim 8, where the tilt-angle adjustment mechanism is attached to the first mounting structure and selectively engages the second mounting structure with the first mounting structure.

10. The loudspeaker mounting assembly of claim 8, where the second mounting structure includes a plurality of recesses, and the tilt-angle adjustment mechanism includes a pin selectively insertable into one of the plurality of the recesses.

11. A loudspeaker mounting assembly, comprising:

a first mounting structure annularly disposed about a first axis and having a first opening lying perpendicular to the first axis, the first mounting structure including a first wall extending away from a rear side of the first mounting structure;

a second mounting structure annularly disposed about a second axis and having a second opening lying perpendicular to the second axis, the second mounting structure coupled to the first mounting structure at a pivot axis and tiltable about the pivot axis from an on-axis position to a maximum off-axis position away from the rear side, the second mounting structure including a second wall defining an opening therethrough, where the pivot axis is radially displaced from the first axis and where:

at the on-axis position, the second opening is located proximate to the first opening and the second axis is substantially parallel to the first axis;

at the maximum off-axis position, the second axis is substantially parallel to the first wall and the second wall being tiltable about the pivot axis in relation to the first wall; and an overall length of the first wall varies from a minimum value at a first position on the first wall to a maximum value at a second position on the first wall.

12. The loudspeaker mounting assembly of claim 11, where a loudspeaker is coupled to the second mounting structure and tiltable with the second mounting structure about the pivot axis.

13. The loudspeaker mounting assembly of claim 12, where the loudspeaker includes a diaphragm, the diaphragm includes a front surface generally aligned with the second opening relative to the second axis, and the front surface includes an outer periphery located proximate to the second opening.

14. The loudspeaker mounting assembly of claim 11, where the first mounting structure includes an outer frame and an inner frame coupled to the outer frame, and the inner frame is annularly disposed about the first axis and rotatable about the first axis relative to the outer frame.

15. The loudspeaker mounting assembly of claim 14, further including a retainer device positioned in overlapping relation to the inner frame to prevent the inner frame from tilting relative to the outer frame.

16. The loudspeaker mounting assembly of claim 15, further including a first hinge portion and a second hinge portion, where the first hinge portion is attached to the first mounting structure and is generally located at the pivot axis, and the second hinge portion is attached to the second mounting structure and is generally located at the pivot axis.

17. The loudspeaker mounting assembly of claim 11, further including a coupling device coupling the second mounting structure to the first mounting structure at the pivot axis.

18. The loudspeaker mounting assembly of claim 11, further including a tilt-angle adjustment mechanism selectively engaging the second mounting structure, where the second mounting structure is tiltable about the pivot axis through a plurality of tilt angles between the second mounting structure and the first mounting structure, each tilt angle being selectable by the tilt-angle adjustment mechanism.

19. The loudspeaker mounting assembly of claim 18, where the tilt-angle adjustment mechanism is attached to the first mounting structure and selectively engages the second mounting structure with the first mounting structure.

20. The loudspeaker mounting assembly of claim 18, where the second mounting structure includes a plurality of recesses, and the tilt-angle adjustment mechanism includes a pin selectively insertable into one of the plurality of the recesses.

21. A loudspeaker mounting assembly, comprising:

a first mounting structure annularly disposed about a first axis and having a first opening lying perpendicular to the first axis, the first mounting structure including a first wall extending away from a rear side of the first mounting structure; and a second mounting structure including a front side, a front end at the front side and annularly disposed about a second axis, a rear side, and a second wall defining an opening therethrough and extending from the front side to the rear side away from the front side, the second mounting structure coupled to the first mounting structure at a pivot axis, where the pivot axis is radially displaced from the first axis and where:

the front end has a second opening lying perpendicular to the second axis;

the second mounting structure is tiltable about the pivot axis from an on-axis position to a maximum off-axis position away from the rear side, and to a plurality of intermediate off-axis positions between the on-axis position and the maximum off-axis position;

at the on-axis position, the second opening is located proximate to the first opening and the second axis is substantially parallel to the first axis;

at one of the plurality of the intermediate off-axis positions, the second axis, in a direction generally out from the front side and away from the second mounting structure, diverges away from the first wall and the second wall being tiltable about the pivot axis in relation to the first wall; and an overall length of the first wall varies from a minimum value at a first position on the first wall to a maximum value at a second position on the first wall.

22. The loudspeaker mounting assembly of claim 21, where a loudspeaker is coupled to the second mounting structure and tiltable with the second mounting structure about the pivot axis.

23. The loudspeaker mounting assembly of claim 21, where the first mounting structure includes an outer frame and an inner frame coupled to the outer frame, and the inner frame is annularly disposed about the first axis and rotatable about the first axis relative to the outer frame.

24. The loudspeaker mounting assembly of claim 23, further including a retainer device positioned to prevent the inner frame from tilting relative to the outer frame while permitting rotation of the inner frame relative to the first axis.

25. The loudspeaker mounting assembly of claim 21, further including a coupling device coupling the second mounting structure to the first mounting structure at the pivot axis, the coupling device including a first hinge portion attached to the first mounting structure and a second hinge portion attached to the second mounting structure, where the second hinge portion is rotatable about the pivot axis relative to the first hinge portion.

26. The loudspeaker mounting assembly of claim 21, further including a tilt-angle adjustment mechanism selectively engaging the second mounting structure, where the second mounting structure is tiltable about the pivot axis through a plurality of tilt angles between the second mounting structure and the first mounting structure, each tilt angle being selectable by the tilt-angle adjustment mechanism.

* * * * *